United States Patent [19]

Minami et al.

[11] Patent Number: 4,513,725

[45] Date of Patent: Apr. 30, 1985

[54] DEVICE FOR SUPPLYING FUEL TO A PRESSURE CARBURETOR

[75] Inventors: Shunji Minami, Fukuroi; Hiroshi Kimura, Iwata, both of Japan

[73] Assignee: Yamaha Hatsudoki Kabushiki Kaisha, Iwata, Japan

[21] Appl. No.: 297,320

[22] Filed: Aug. 28, 1981

[30] Foreign Application Priority Data

Aug. 29, 1980 [JP] Japan ..... 55-119559

[51] Int. Cl.[3] ..... F02M 5/00

[52] U.S. Cl. ..... 123/511; 123/463; 123/383; 261/DIG. 51; 261/70

[58] Field of Search ..... 123/514, 457, 511, 459, 123/512, 516, 517, 463, 383; 261/DIG. 51, 67, 68, 70

[56] References Cited

U.S. PATENT DOCUMENTS

| | | | |
|---|---|---|---|
| 1,471,417 | 10/1923 | Rateau | 261/DIG. 51 |
| 1,955,037 | 4/1937 | Uiel | 123/463 |
| 2,020,778 | 11/1935 | Gregg | 261/DIG. 51 |
| 2,239,305 | 4/1941 | Tacconi | 123/513 |
| 2,297,129 | 9/1942 | Bohnstedt | 123/511 |
| 2,529,942 | 11/1950 | Holthouse | 261/70 |
| 3,187,732 | 6/1965 | Orner | 261/DIG. 51 |
| 3,868,822 | 3/1975 | Keller | 123/383 |
| 4,044,746 | 8/1977 | Kaye | 123/511 |
| 4,257,378 | 3/1981 | Bascle | 123/512 |
| 4,284,039 | 8/1981 | Bellicardi | 123/463 |

FOREIGN PATENT DOCUMENTS

| | | | |
|---|---|---|---|
| 54-125917 | 9/1979 | Japan | 123/511 |
| 286939 | 3/1928 | United Kingdom | 123/511 |

*Primary Examiner*—Carl S. Miller

*Attorney, Agent, or Firm*—Ernest A. Beutler

[57] ABSTRACT

Several embodiments of induction systems having forced induction and a regulated fuel pump for delivering fuel to the charge forming device at a pressure that is related to the pressure in the induction system. In some embodiments the pressure is sensed above the level of the fuel in the fuel bowl of the charge forming device, and in others the pressure is sensed in a plenum chamber upstream of the charge forming device inlet. A check valve arrangement is also provided in the fuel line in one embodiment for preventing the backflow of fuel under conditions when the engine is stopped.

6 Claims, 7 Drawing Figures

DEVICE FOR SUPPLYING FUEL TO A PRESSURE CARBURETOR

BACKGROUND OF THE INVENTION

This invention relates to a fuel supply system for the pressurized carburetor of an internal combustion engine, and more particularly to an improved fuel feed system for an engine.

As is well known, charge forming devices such as carburetors employ a float controlled fuel bowl that is intended to provide a uniform fuel head for the discharge circuits of the charge forming device. The float operated valve of such devices is intended to maintain a uniform fuel level so as to minimize variations in mixture strength. Although this is the principle of operation of such devices, in practice the float operated valve does not truly maintain a uniform fuel head under all running conditions.

The problems noted in the preceding paragraph are particularly prevalent in engines having forced induction systems, such as those employing superchargers, be they direct driven or turbochargers. Throughout this specification and in the claims the word "supercharger" shall be used generically to cover both types of devices. When a supercharger is employed, and particularly one in which the blower output is delivered to the inlet of the charge forming device of the carburetor, it has been the practice to insure that the resulting pressure is also transmitted to the fuel bowl so that a more uniform fuel discharge relationship will be established. If the fuel bowl is not so pressurized, the discharge of the fuel circuit would be into an area of higher pressure as the blower pressure increased. This would result in a reduced fuel flow from that desired. Although the pressurization of the fuel bowl will minimize the variations in fuel flow due to differences in pressure between the discharge of the fuel circuit and the air pressure in the fuel bowl, another problem results from such an arrangement. That is, the fuel pump which delivers fuel to the fuel bowl must act against a higher pressure at high engine speeds and with high boost pressure. This will cause diminished fuel flow, variations in the fuel level in the fuel bowl and resulting fuel discharge variations and uneven running.

It is therefore a principal object of this invention to provide a improved fuel feed system for an internal combustion engine.

It is another object of this invention to provide a fuel feed system for an engine that minimizes variations in fuel flow due to pressure variations in the charge forming device and induction system.

It is a further object of this invention to provide an improved fuel feed system for a pressurized carburetor wherein the fuel pump discharges into the fuel bowl at substantially consistant pressure differiential regardless of the pressure in the fuel bowl.

Still another problem exists in conjunction with the fuel feed system of an internal combustion engine. Frequently when the engine is shut off, the fuel has a tendency to be forced back out of the fuel bowl into the fuel tank or into a overflow condition. This results from the heating of the fuel bowl and the generation of an increased pressure which tends to cause the fuel to back flow. In addition, this condition can tend to cause difficulty in restarting a hot engine due to a condition commonly known as "vapor lock."

It is, therefore, a further object of this invention to provide a fuel feed arrangement for an internal combustion engine which reduces the loss of fuel from the fuel bowl when the engine is stopped.

It is another object of this invention to provide a system wherein a vapor lock condition may be readily cured.

SUMMARY OF THE INVENTION

A first feature of this invention is adapted to be embodied in a fuel feed and induction system for an internal combustion engine having a charge forming device with a fuel bowl and a fuel discharge circuit fed from the fuel bowl and a fuel pump for delivering fuel to the fuel bowl. In accordance with this feature of the invention means are provided for varying the pressure at which the fuel pump delivers fuel to the fuel bowl in relation to the pressure at a point in the system.

Another feature of the invention is also adapted to be embodied in a fuel feed system for an internal combustion engine. In accordance with this feature of the invention, the engine is provided with a fuel pump, a charge forming device having a fuel bowl and conduit means interconnecting the fuel pump with the fuel bowl. In accordance with this feature of the invention, a check valve is interposed in the conduit means for permitting flow from the fuel pump with the fuel bowl but for precluding flow in the opposite direction.

DETAILED DESCRIPTION OF THE PREFERRED EMBODIMENTS

Embodiment Of FIGS. 1 Through 5

Figure 1:
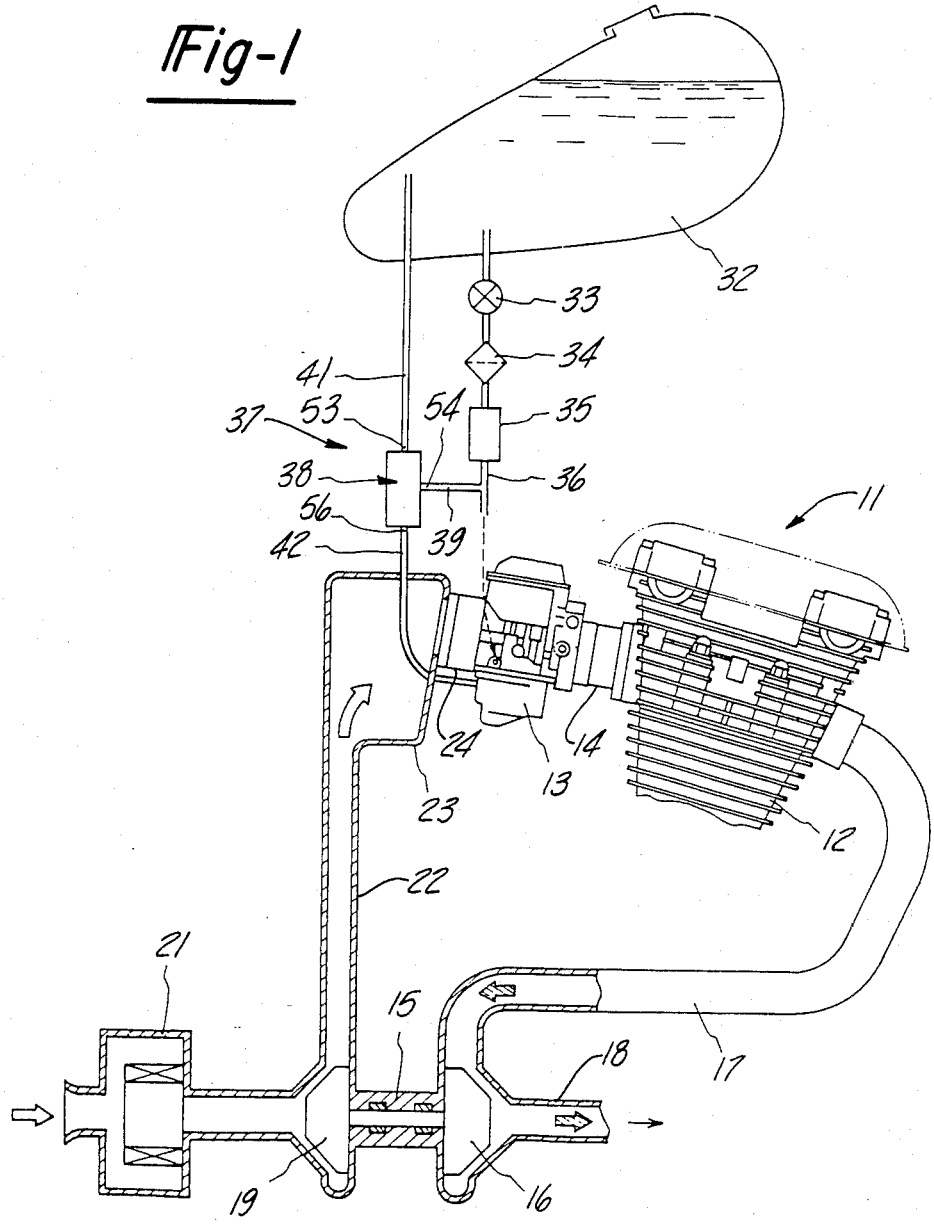
FIG. 1 is a partially schematic side elevational view of a motorcycle having an engine induction and fuel feed system constructed in accordance with an embodiment of the invention and having parts shown in section.

A first embodiment of this invention is particularly adapted to be employed in conjunction with the induction and fuel feed system of a turbocharged internal combustion engine for use in conjunction with a motorcycle. Such an embodiment is identified generally by the reference numeral 11 and the systems are shown schematically in FIG. 1 wherein certain components are shown in elevation, and others are shown in cross section.

The system includes an engine, identified generally by the reference numeral 12, having an induction and fuel feed system including one or more charge forming devices which, in the illustrated embodiment, comprise a carburetor 13, which may be of any known type. The carburetor 13 discharges into the cylinders of the engine 12 via an intake manifold 14 in a known manner.

Air under pressure is delivered to the inlet of the carburetor 13 from a turbocharger, indicated generally by the reference numeral 15. The turbocharger 15 includes a turbine 16 that is driven by the exhaust gases delivered from the engine 12 through an exhaust manifold 17. The exhaust gases are discharged to the atmosphere through an outlet pipe 18 and muffler or the like (not shown). Affixed for rotation with the exhaust driven turbine 16 is a compressor impeller 19. Atmospheric air is delivered to the compressor stage 19 from an air cleaner 21. The compressor 19 discharges through a discharge conduit 22 into a plenum chamber 23 which, in turn, communicates with the carburetor air inlet 13 through a short connecting section 24.

Figure 5:
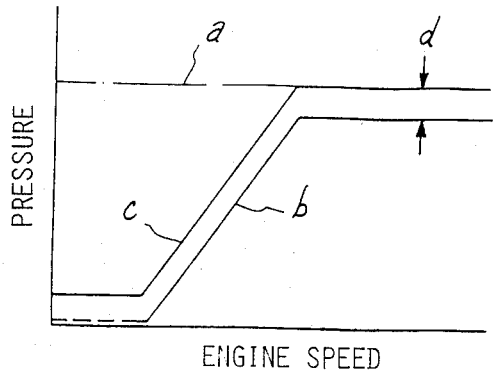
FIG. 5 is a graphical representation of engine speed and various pressures in the induction and fuel system.

When the engine 12 is running at low speeds, the turbocharger 15 will generate substanatially no boost and the pressure in the plenum chamber 23 and inlet to the carburetor 13 will be substantially at atmospheric pressure. As the speed of the engine 12 increases, the exhaust gases will increase the speed of the turbine 16 and compressor stage 12 so as to increase the amount of boost to the inlet air charge. In FIG. 5, the curve b shows the relationship of the turbocharger output pressure in relation to engine speed. At low speeds the boost will be relatively insignificant. As the speed on the engine increases to that above a predetermined relative low speed, the output pressure of the compressor 19 will rise steeply until a maximum boost pressure is obtained. The turbocharger 15 is designed so that the boost pressure will reach a maximum value at less than maximum engine speed. This pressure will be maintained up to the maximum speed of the engine 12. In a specific embodiment of the invention as applied to a motorcycle, the maximum speed of the turbocharger 15 will be approximately 100,000 rpm and at this speed the boost pressure will be approximately 0.6 kilograms per square centimeter (8.77 psi). The carburetor 13 has a fuel bowl 25 (FIGS. 2 and 30 that receives fuel from an inlet feed 26 in a manner to be described. The level of the fuel within the fuel bowl 25 is controlled by means of a float 27 that is pivotally supported on a float shaft 28 and which cooperates with a needle valve 29 in a known manner so as to control the admission of fuel from the inlet fitting 26 into the fuel bowl 25 so as to maintain a substantially consistent head in the fuel bowl 25. One or more fuel discharge circuits (not shown) extend from the fuel bowl 25 to the carburetor venturi section 31 for delivering of fuel thereto in a known manner. Since the fuel discharge circuits discharge into the venturi section 31 and the pressure therein varies in relation to the pressure generated by the turbocharger compressor stage 19, this pressure is also transmitted in any suitable manner to the area above the fuel lever 30 in the fuel bowl 25. As a result variations in the pressure between the inlet and outlet sides of the fuel discharge circuits due to variations in induction system pressure generated by the turbocharger 15 are minimized.

The fuel tank 32 delivers fuel through a main shutoff valve 33 and fuel filter 34 to a fuel pump 35. The fuel pump 35 may be of either the electrical or mechanically driven type and discharges into a discharge conduit 36 which communicates with the carburetor fuel inlet 26. The construction thus far described is conventional.

Since the area above the fuel in the fuel bowl 25 is pressurized as aforenoted, to miminize variations in pressure into the inlet and outlet sides of the fuel discharge circuits due to variations in pressure generated by the turbocharger 15, the pressure at the discharge end of the fuel conduit 36 against which the pump 35 operates will vary. Thus, with previously employed fuel systems of the conventional type, there is a tendency for the discharge of the fuel pump to be diminished at high engine speeds and high boost pressures. This causes uneven fuel delivery and uneven and rough engine operation.

Figure 2:
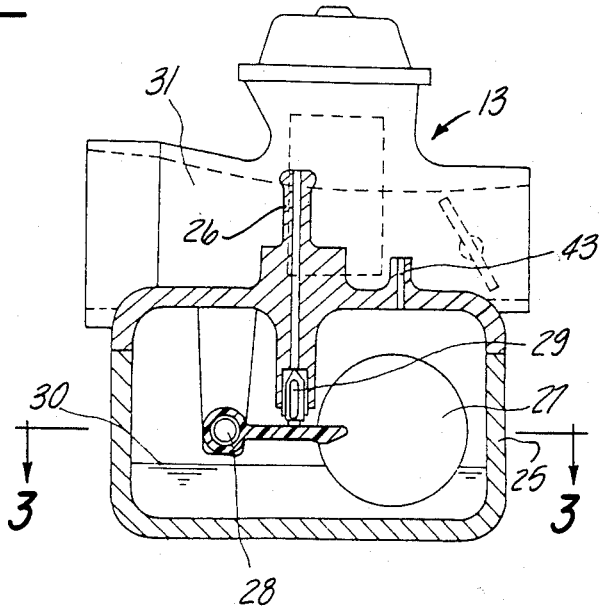
FIG. 2 is an enlarged side elevational view of the carburetor of the engine shown in FIG. 1 and shows the fuel bowl in cross section.
Figure 3:
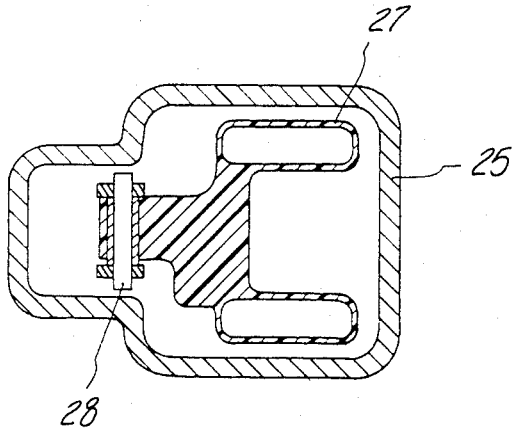
FIG. 3 is a cross sectional view taken along the line 3—3 of FIG. 2.

In order to minimize such variations, a pressure regulator system, identified generally by the reference numeral 37, and further including a fuel pressure regulator 38 is provided. This pressure regulating system controls the return of a controlled portion of the fuel delivered by the fuel pump 35 back to the fuel tank through a bypass line 39 and fuel return line 41. The amount of such bypass is controlled in relation to the pressure in the induction system and, in this embodiment, by the pressure above the fuel level 30 in the fuel bowl 25. For this purpose a pressure sensing conduit 42 extends from the pressure regulator 38 to a pressure sensing port 43 formed in the fuel bowl 25 above the fuel level 30 therein (FIG. 2).

Figure 4:
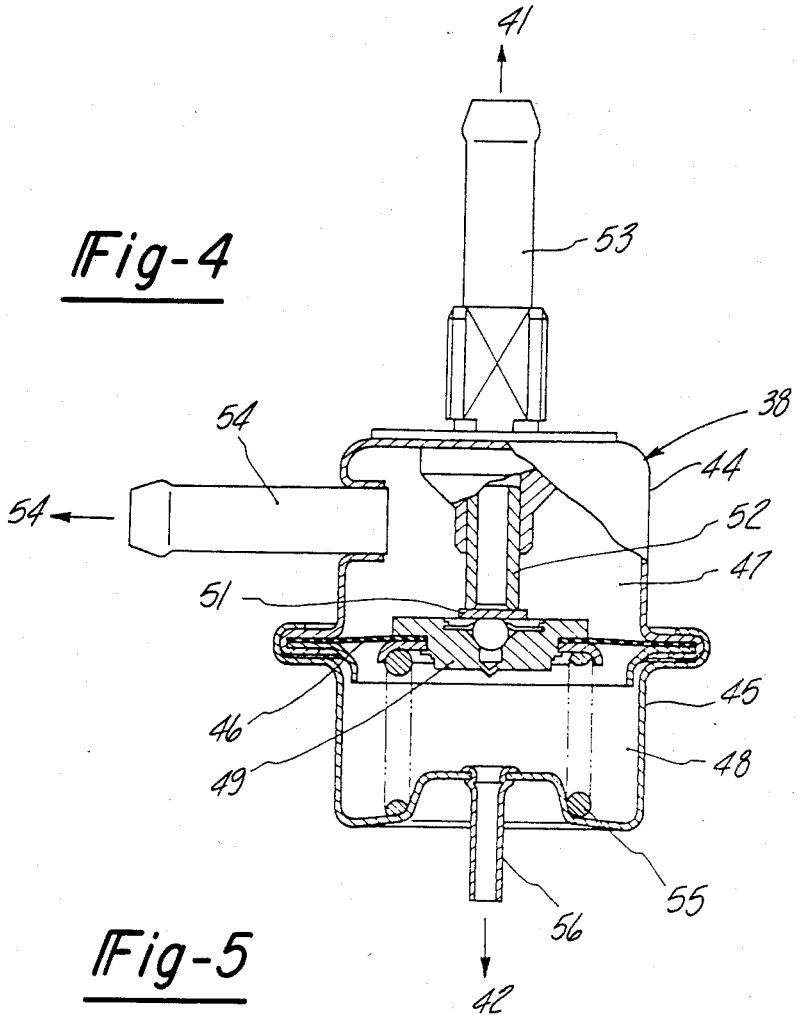
FIG. 4 is an enlarged view of the regulator employed in the embodiment of FIG. 1 with a portion broken away.

The construction of the pressure regulator 38 is shown best in FIG. 4. The regulator 38 includes a generally cup shaped outer housing having an upper shell 44 and a lower shell 45 with a diaphragm 46 being clamped between mating flanges of the shells 44 and 45. The diaphragm 46 divides the interior of the regulator body into a fuel chamber 47 and a pressure sensing chamber 48. A valve plate 49 is affixed centrally to the diaphragm 46 and has a valve element 51 that cooperates with a valve seat formed at the lowermost end of a return pipe 52. The return pipe 52 communicates with a return nipple 53 which, in turn, communicates with the return conduit 41. Fuel is delivered to the fuel chamber 47 from the bypass line 39 via an inlet nipple 54.

A coil spring 55 is positioned within the pressure sensing chamber 48 and acts against the lower side of the diaphragm 46 so as to normally urge the valve plate 49 and valve element 51 into a closed position with the lower end of the bypass pipe 52. The pressure above the level of the fuel 30 in the fuel bowl 25 is transmitted to the chamber 48 through the conduit 42 and a nipple 56 formed on the lower housing portion 45.

The regulator 38 is constructed so that the fuel pressure delivered from the pump 35 to the carburetor inlet 26 and specifically against the needle valve 29 is at a constantant pressure differential above the pressure in the induction system delivered by the turbocharger compressor 19. In this embodiment this pressure is related to the pressure above the fuel level 30 in the float bowl 25. This relationship is shown in FIG. 5 wherein, as has been previously noted, the discharge pressure of the compressor 19 in relation to engine speed is represented by the curve b. The fuel pump 35 is constructed so as to deliver a predetermined maximum pressure which is at a fixed value above the maximum pressure generated by the supercharger compressor 19. This constant fuel pump pressure is indicated by the horizontal line "a". The regulator 38 operates to bypass an amount of fuel related to the inducted system air pressure so that the actual fuel pressure delivered to the carburetor inlet 26 follows the curve "c". The arrangement is such that at low engine speeds when the compressor 19 is not generating any significant boost pressure, the pressure in the regulator pressure sensing chamber 48 will be substantially equal to atmospheric pressure and the preload of the spring 55 will determine the pressure at which the valve element 51 opens. The preload is chosen so that this pressure is equal to the difference between the fuel pump pressure "a" and the maximum compressor pressure at high engine speeds, which is equal to the offset "d" in FIG. 5. As the speed of the engine 12 increases, the turbine 16 will drive the compressor 19 at a high enough speed so as to generate a boost pressure and the curve "b" will begin its rise, as shown in FIG. 5. As the pressure increases, a greater pressure will be experienced in the chamber 48 and the pressure of the fuel delivered by the fuel pump through the bypass line 39 to the inlet feed 54 will have to be greater before the valve element 51 will open to bypass fuel back to the tank through the conduit 41. Thus, the offset "d" in the pressure of the fuel delivery to the carburetor inlet 26 in relation to the pressure above the fuel level 30 in the fuel bowl 25 will be maintained. It should thus be readily apparent that the fuel pressure delivered to the inlet 26 will always be at the same absolute value relative to the air pressure in the fuel bowl 25 so that variations in fuel level, and accordingly the fuel discharge rate, will be minimized.

Figure 6:
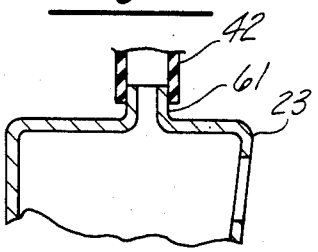
FIG. 6 is a partially schematic view, in part similar to FIG. 1, showing another embodiment of the invention.

Embodiment of FIG. 6

As was noted in the description of the embodiments of FIGS. 1 through 5, it is desirable to provide the fuel delivery at a pressure that is related to the air pressure in the induction system. In the preceding embodiments, this air pressure was sensed through the sensing port 43 in the fuel bowl 25. it is also possible to provide the air pressure control to the regultor 38 from the air pressure in the plenum chamber 23. Such an arrangement is shown in FIG. 6 which in all other regards is the same as the preceding embodiment and for this reason only the induction system pressure sensing portion has been illustrated.

As seen in this embodiment, the plenum chamber 23 is provided with a pressure sensing port 61 to which the conduit 42 of the pressure regulator 38 extends so as to provide communication with the regulator pressure sensing chamber 48. In all other regards this embodiment is the same as has already been described and for that reason further description is believed to be unnecessary.

Figure 7:
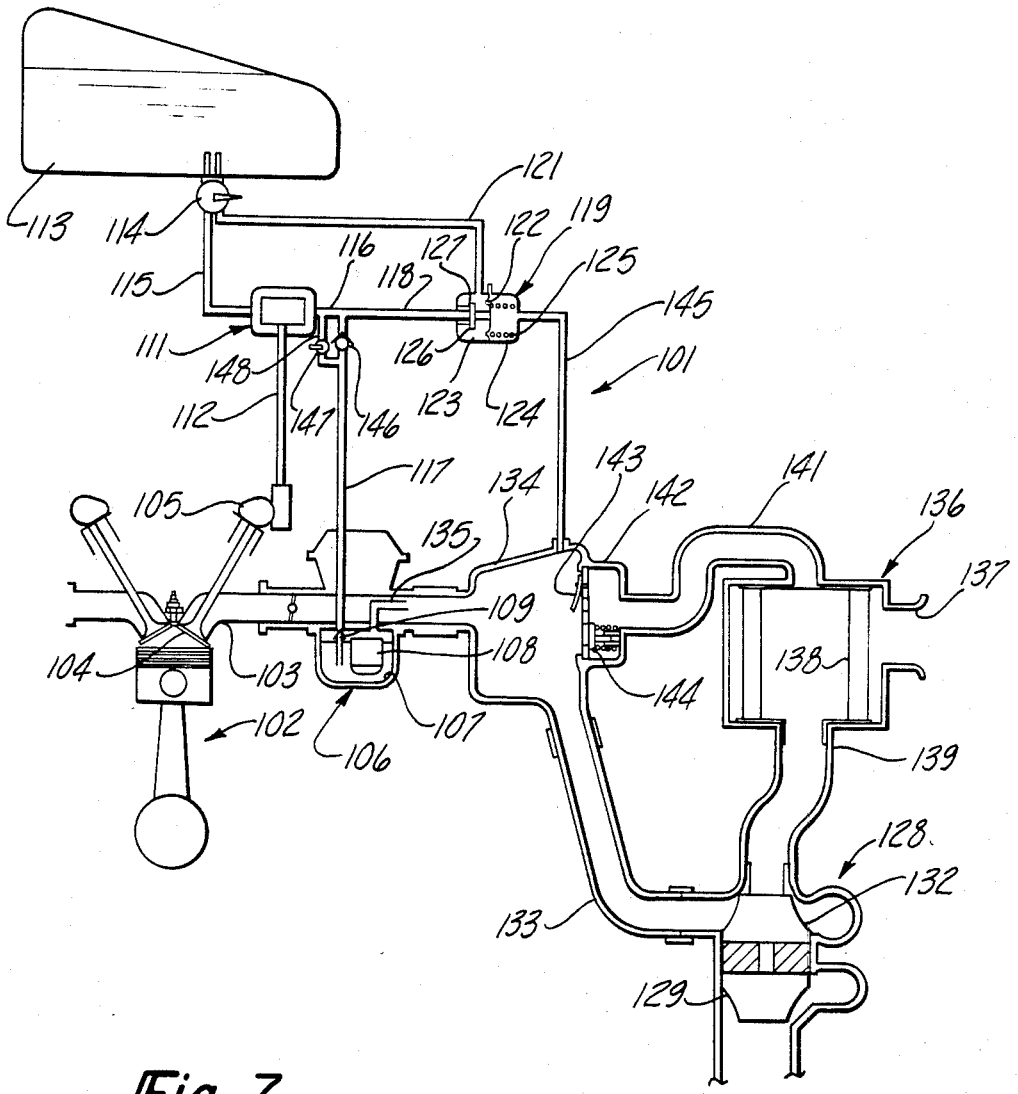
FIG. 7 is a partially schematic cross sectional view, in part similar to FIGS. 1 and 6, and shows a still further embodiment of the invention.

Embodiment of FIG. 7

FIG. 7 illustrates another embodiment of the invention that also employs a pressure regulator in a bypass line for maintaining a fuel pressure delivery to the fuel bowl at a constant pressure above the induction system pressure. In addition, this embodiment incorporates an arrangement for preventing discharge of fuel from the fuel bowl back into the fuel system when the engine is shut off, provides an arrangement wherein vapor lock in the fuel feed system may be readily purged, and also provides an improved air induction arrangement whereby the inlet air need not pass across the impeller of the compressor at low engine speeds when relatively no boost is generated.

FIG. 7 shows another embodiment of this invention as applied to the power train for a motorcycle, which power train is indicated generally by the reference numeral 101. The power train 101 includes an engine 102 which is shown partially schematically and may be of any known type. A reciprocating type of engine is illustrated and has an intake passage 103 which terminates at an inlet valve 104 that is operated in a known maner by an inlet cam shaft 105. Since the invention relates to the induction system for the engine 102, other details of the engine construction will not be described.

A carburetor, indicated generally by the reference numeral 106, serves the intake passage 103 and has a fuel bowl 107 in which a constant level of fuel is maintained by means of a float 108 and float operated needle valve 109. As is well known, the fuel in the fuel bowl 107 serves the various discharge circuits of the carburetor 106, which have not been illustrated and which may be of any known type. It is also desirable to maintain a uniform level of fuel in the bowl 107 under all conditions so as to avoid variations in mixture strength. Fuel is supplied to an inlet fitting of the carburetor by means of a mechanical fuel pump 111 which is driven by the inlet cam shaft 105 via a fuel pump drive 112. Fuel is delivered to the fuel pump 111 from a fuel tank 113 via a manually operated shutoff valve 114 and inlet conduit 115. The fuel pump 111 has a discharge port 116.

As with the preceding embodiment, the fuel pump discharge port 116 serves a fuel delivery line 117 that extends to the inlet of the carburetor 106 and a bypass line 118 which extends to a pressure regulator, indicated generally by the reference numeral 119. The pressure regulator 119 controls the amount of fuel returned to the tank via a return line 121 which is also controlled by the manual shutoff valve 114.

As in the preceding embodiment, the regulator 119 has an outer housing in which a diaphragm 122 is positioned so as to divide this housing into a fuel chamber 123 and a pressure sensing chamber 124. A coil spring 125 is positioned in the pressure chamber 124 to urge a valve element 126 carried by the diaphragm 122 into sealing engagement with a valve seat 127 so as to close off communication of the bypass line 118 with the return line 121.

As was also true with the previously described embodiment, the engine 102 is provided with a turbocharger, indicated generally by the reference numeral 128. The turbocharger 128 has an exhaust turbine 129 which is driven by the engine exhaust gases via a manifold 131. The turbine 129 drives a compressor 132 that discharges through a pressure conduit 133 which in turn communicates with a plenum chamber 134 in registry with the carburetor air inlet. A vent passage 135 is provided in the carburetor 106 so that the pressure above the fuel in the fuel bowl 107 will be the same as the pressure in the plenum chamber 134.

The engine 102 is provided with an air cleaner, indicated generally by the reference numeral 136, which has a generally cylindrical configuration, with an air inlet 137. A cylindrical filter element 138 of any known type is provided in the air cleaner housing 136. In accordance with this invention, the air cleaner housing 136 has two air outlets, a supercharger outlet 139 and an atmostpheric outlet 141. The supercharger outlet 139 serves the compressor stage 132 of the turbocharger 128.

The atmospheric outlet 141, which is disposed axially opposite to the supercharger outlet 139, serves the plenum chamber 134 through a valve box 142. A reed type check valve 143 is provided in the valve box 142 and is adapted to open and permit flow through the atmospheric passage 141 into the plenum chamber 134 when atmospheric pressure is greater than induction system pressure in the chamber 134. This will normally occur during the stage when the supercharger compressor stage 132 is not generating a significant boost. Once the supercharger stage 132 begins to generate a positive boost in the plenum chamber 134, the reed valve 143 will close and all of the inlet air will be supplied through the supercharger inlet 139. By providing their alternate inlets, the supercharger compressor stage 132 will not offer a flow restriction to the inducted air when the turbocharger 128 is not generating any significant boost.

The valve box 142 also incorporates a relief or pop off valve 144 which will serve the purpose of limiting the maximum boost delivered by the compressor stage 132. When a pressure greater than desired is experienced in the plenum chamber 134, the relief valve 144 will open and permit the return of the excess air to the air cleaner through the atmospheric passage 141.

As in the previously described embodiment, the pressure regulator 119 insures that the pressure of the fuel delivered by the fuel pump 111 through the conduit 117 will be at a fixed value above the induction system pressure. For this purpose the pressure chamber 124 of the regulator 119 is provided with a conduit 145 that extends to the plenum chamber 134 for delivering this pressure to the regulator pressure chamber 124. As with the embodiments of FIGS. 1 through 5, the regulator chamber 124 could be in direct communication with the fuel bowl 107 at a point above the fuel level therein via an appropriate conduit.

In view of the fact that the regulator 119 and its operation is the same as the previously described embodiment, a detailed description of the operation of this embodiment is not believed to be necessary. Suffice to say that the regulator 119 will serve to bypass sufficient fuel from the bypass passage 118 back to the fuel tank 13 through the return line 121 so as to maintain the desired pressure differential between the pressure of fuel delivered to the carburetor float bowl 107 and the pressure in the induction system.

When an engine is stopped, the heat present in proximity to the fuel bowl tends to cause the fuel in the bowl to expand and even vaporize. Normally, such expansion causes the fuel to be driven back through the conduit 117 when this condition occurs. In order to prevent this, a check valve 146 is provided in the conduit 117 downstream of the fuel pump 111. The check valve 146 is provided with a spring (not shown) which tends to urge it to its closed position. The valve 146 will open when the delivery pressure of the fuel pump exceeds the pressure in the conduit 117 downstream of the check valve 146 and the force of this return spring. Normally, this pressure is set so that the check valve 146 will open when the needle valve 109 is opened and demands flow and the engine is running. When the engine is stopped, however, the check valve 146 will seat and prevent any fuel from being driven back from the fuel bowl 107 into the connduit 116.

Under some conditions even though the check valve 146 is employed, there may be air occupying the conduit 117 either due to long-term drainage or in the event of vapor lock. It should be noted, however, that vapor lock is less likely to occur because of the check valve 146. In order to purge the line 117 of air and to fill it with fuel, a manually operated valve 147 is positioned in a line 148 that bypasses the check valve 146. Opening of the valve 147 will permit fuel to flow into the conduit 117.

It is to be understood that several embodiments of the invention have been disclosed and other modifications described. Various changes and modifications may be made without departing from the spirit and scope of the invention. For example, other types of pressure regulators than those disclosed may be employed. Certain features may be used with other than turbocharged engine, such as the check valve 146, and other features may be used with engines having other types of forced induction systems. All such modifications are deemed to fall within the scope of the invention, as defined by the appended claims.

We claim:

1. In a fuel feed and induction system for an internal combustion engine comprising a charge forming device having a fuel bowl, a float controlled valve for controlling the level of fuel in said fuel bowl, and a fuel discharge circuit fed by said fuel bowl, and a fuel pump for delivering fuel to said fuel bowl, the improvement comprising means for controlling the pressure at which said fuel pump delivers fuel to said fuel bowl in relation to the pressure above the fuel in said fuel bowl for maintaining a predetermined pressure differential between the delivery pressure and the pressure in the fuel bowl.

2. A fuel feed and induction system as set forth in claim 1 wherein the area above the fuel in the fuel bowl is subjected to a pressure existing at the inlet to the charge forming device.

3. A fuel feed and induction system as set forth in claim 2 wherein there is a plenum chamber in communication with the inlet to the charge forming device and the pressure above the fuel in the fuel bowl is the pressure in the plenum chamber.

4. A fuel feed and induction system as set forth in any of the preceding claims further including a supercharger discharging into the inlet of the charge forming device.

5. A fuel feed and induction system as set forth in claim 4 wherein the supercharger comprises a turbocharger.

6. A fuel feed and induction system as set forth in claim 1 wherein the fuel pump delivery pressure is regulated by bypassing a proportion of its outlet back to a fuel tank which feeds the fuel pump.

* * * * *